US005673662A

United States Patent [19]

Rigamonti

[11] Patent Number: 5,673,662

[45] Date of Patent: Oct. 7, 1997

[54] DIRECT-ACTING HYDRAULIC TAPPET WITH REDUCED AERATION

[75] Inventor: Flavio Rigamonti, Giorgio Canavese, Italy

[73] Assignee: Eaton Corporation, Cleveland, Ohio

[21] Appl. No.: 730,110

[22] Filed: Oct. 15, 1996

[30] Foreign Application Priority Data

Oct. 27, 1995 [IT] Italy ..... MI95A2218

[51] Int. Cl.[6] ..... F01L 1/25

[52] U.S. Cl. ..... 123/90.55; 123/90.49; 74/569

[58] Field of Search ..... 123/90.48, 90.49, 123/90.52, 90.55; 74/569

[56] References Cited

U.S. PATENT DOCUMENTS

| | | | |
|---|---|---|---|
| 4,397,271 | 8/1983 | Gardner | 123/90.55 |
| 4,437,439 | 3/1984 | Speil | 123/90.56 |
| 5,022,361 | 6/1991 | Schut | 123/90.55 |
| 5,129,374 | 7/1992 | Flavio | 123/90.55 |
| 5,586,528 | 12/1996 | Speil | 123/90.55 |

*Primary Examiner*—Weilun Lo
*Attorney, Agent, or Firm*—L. J. Kasper

[57] ABSTRACT

A direct-acting hydraulic tappet having a cup-like tappet body which includes a cylindrical projection extending inwardly from the base of the body and in which the hydraulic element of the tappet is received. A resiliently deformable diaphragm is received in the space formed between the peripheral wall of the tappet body and the cylindrical projection. The diaphragm defines two concentric outer and inner annular wells for allow oil entering the tappet body from an external source to overflow from the outer well into the inner well to provide a supply of deaerated oil to the low pressure inner chamber of the tappet. The diaphragm is fixed to the tappet body by being received in slots formed in the body and in the cylindrical projection, or by means of a press fit therein.

3 Claims, 1 Drawing Sheet

DIRECT-ACTING HYDRAULIC TAPPET WITH REDUCED AERATION

Figure 1:
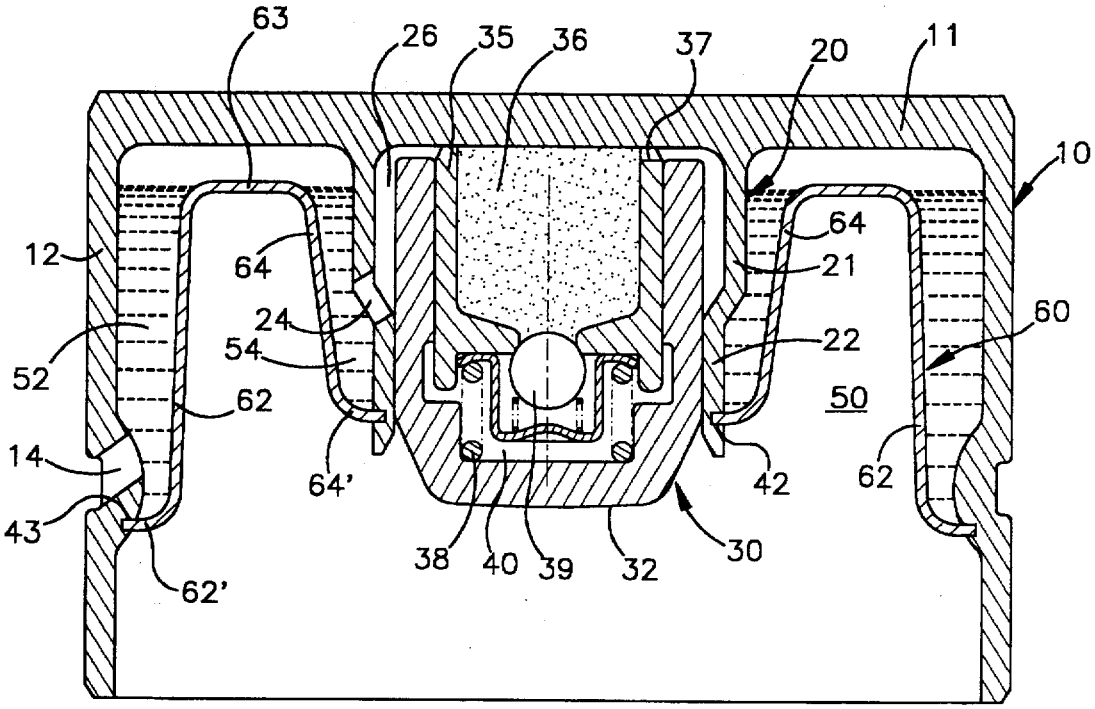

The present invention relates to a direct-acting hydraulic tappet, and more particularly to a tappet including means for preventing air, present in the oil coming from the lubricating circuit, from reaching the inner reservoir of the tappet and then possibly the high pressure chamber.

Direct-acting hydraulic tappets generally consist of a first outer element or tappet body engaging the driving cam and including a low pressure outer reservoir, and a second inner element telescopically sliding inside the tappet body and contacting the stem of a valve of the internal combustion engine. A low pressure inner reservoir and a high pressure variable volume chamber are formed by a third element telescopically received within the second element within the tappet body, the high pressure chamber communicating with the inner reservoir through a one-way ball valve.

A disadvantage of this type of tappet is that there is air entrained by the low pressure oil in the outer reservoir, which air, consequently, will also pass into the inner reservoir as well as into the high pressure chamber, thereby reducing the amount of oil present in said chamber when the engine is stopped and then restarted, which reduces the effectiveness of the tappet and causes noise until the air is dissipated.

In order to minimize the above-mentioned disadvantage of air entrained by the oil passing into the high pressure chamber, it is known to provide multiple annular reservoirs; however, the prior structures are fairly complicated and some require welding, which adds to the cost.

Accordingly, an object of the present invention is to provide a hydraulic tappet of a particularly inexpensive and simple construction, not requiring welded parts, provided with an outer reservoir for the low pressure oil, which provides a sufficient deaerated oil to the high pressure chamber to prevent noise when the engine is started.

According to this invention, two concentric annular wells are formed in the space between the peripheral wall of the tappet body and the inner element by fitting thereinto, by means of resilient deformation, a stamped diaphragm made of a resiliently deformable material formed as two asymmetrical walls connected to one another, wherein the top wall connecting said walls constitutes a weir or dam surface between the outer annular well and the inner well over which the oil must flow to reach the inner reservoir. The inlet conduit for allowing oil to pass to the inner reservoir which in turn supplies the high pressure chamber of the tappet, leads to the base of the inner annular well to take up substantially deaerated oil, since oil will remain in the inner well as the engine is stopped.

Other objectives and advantages of the invention will be apparent from the following description with reference to the accompanying drawing where the sole FIGURE is a diametrical vertical cross-sectional view of the tappet according to the invention.

According to the invention, the hydraulic tappet is provided with a tappet body 10 constituted by a single pressed piece having a reversed cup shape and including, at the central portion thereof, a cylindrical projection 20 having a first portion 21 of greater size which is narrowed at its free end portion thereof, thereby providing a cylindrical wall bottom portion 22.

According to a known arrangement, the inner surface of said portion 22 of the projection 20 defines a sliding guide for an inner cup-shaped element 30, the bottom 32 of said element being in contact with the head of the stem of an engine valve (not shown).

A piston 35 slides within said element 30, said piston including a reservoir 36 for supplying oil to a high pressure chamber 40 in known manner.

As is known, as the top surface of the head 11 of the tappet body 10 is downwardly displaced by the lobe of the camshaft cam (not shown), the piston 35, abutting inside said head 11, is pressed downwardly thereby compressing the oil in the high pressure chamber 40. At the end of the first opening of the valve, the piston 35, as necessary, can be again moved upward by the coil spring 38 housed in said inner element 30, thereby causing a pressure differential between the high pressure chamber 40 and the reservoir 36, which will cause oil to flow from the reservoir 36 into chamber 40 through a one-way ball valve 39.

Between the element 30 and the inner wall of the projection 20 is provided a passage 26 communicating with the low pressure inner reservoir 36 through an opening 37 in the sliding piston 35, or alternatively through a recess formed inside the head 11.

According to the invention, in the space 50 between the wall 12 of the body 10 and the projection 20, there is provided a resilient diaphragm 60, made of a drawn metal sheet element or a molded plastic material, said resilient diaphragm having the shape of a surface of revolution generated by two asymmetrical inner and outer walls 62 and 64, respectively, arranged as a reversed U and connected to one another by an upper wall 63.

The diaphragm 60 can be easily engaged, by means of resilient deformation, inside the tappet body 10, since the free end portions 62' and 64' of said walls 62 and 64 are bent at a suitable angle, in opposite directions, and can be engaged either in annular slots 43 and 42 formed inside said wall 12 of the tappet body 10 and at the end of the wall 22 of the cylindrical projection 20, or by means of a simple pressure engagement.

The space 50 is divided by the diaphragm 60, into two concentric annular outer and inner wells 52 and 54 respectively, communicating with one another above the wall 63.

The engine lubricating oil is supplied through a port 14 in the wall 12 of the tappet body 10, and flows into the outer well 52, flows over the wall 63 of the diaphragm 60 and fills the inner well 54 wherein the oil is freed of entrained air, since the air moves upwards due to the difference in specific weight. Accordingly, in the inner well 54, there is available a given amount of deaerated oil, for supplying the reservoir 36 when the engine is restarted.

The inflow of deaerated oil from the bottom of the inner well 54 to the reservoir 36 occurs through a port 24 formed in the wall of the projection 20, substantially at the transition between the wall sections 21 and 22.

The above illustrated and disclosed tappet is constituted by an extremely reduced number of simple elements which can be manufactured inexpensively, without any welded parts, since the diaphragm 60 can either be snap-inserted or forcibly fitted in the body of the tappet.

I claim:

1. A direct-acting hydraulic tappet comprising an inverted cup-shaped body; an inwardly directed cylindrical projection formed on a base of said cup-shaped body; a cup-shaped first element slidingly received within said projection and having a valve contacting surface formed thereon; a cup-shaped second element slidingly received within said first element, said second element defining an inner reservoir therein and a volume between said first and second elements defining a high pressure chamber; and check valve means received within said high pressure chamber and operable to prevent flow from said high pressure chamber to said inner reservoir; characterized by a resilient diaphragm received within an annular space defined between a cylindrical wall of said body and said projection, said diaphragm defining outer and inner concentric and communicating wells within said space; a first inlet port formed in the wall of said body and communicating with said outer well; and a second port formed in said projection to provide a flow path from said inner well to said inner reservoir.

2. A tappet as claimed in claim 1, in which said diaphragm is defined as a surface of revolution generated by two asymmetrical outer and inner walls connected by a top wall, said top wall being spaced from the base of said body to define a flow path between said outer and inner wells.

3. A tappet as claimed in either of claims 1 or 2, in which a first peripheral slot is formed in the wall of said body, and a second peripheral slot is formed in said projection and wherein outer and inner edges of said diaphragm are received in said slots.

* * * * *